US005682750A

United States Patent [19]

Preston et al.

[11] Patent Number: 5,682,750

[45] Date of Patent: Nov. 4, 1997

[54] SELF-CONTAINED LIQUID NATURAL GAS FILLING STATION

[75] Inventors: Duane Preston; Michael Lutgen, both of New Prague; Tom Drube, Lakeville; Paul Drube; Tom Chrisfield, both of Apple Valley, all of Minn.

[73] Assignee: MVE Inc., New Prague, Minn.

[21] Appl. No.: 624,268

[22] Filed: Mar. 29, 1996

[51] Int. Cl.[6] ..... F17C 9/02

[52] U.S. Cl. ..... 62/50.2; 62/50.6; 62/911

[58] Field of Search ..... 62/50.1, 50.2, 62/50.6, 50.7, 911

[56] References Cited

U.S. PATENT DOCUMENTS

| | | | |
|---|---|---|---|
| 3,012,629 | 12/1961 | Walker et al. | 62/911 |
| 3,109,293 | 11/1963 | Williams et al. | 62/50.6 |
| 3,131,713 | 5/1964 | Kelley | 62/50.6 |
| 3,433,028 | 3/1969 | Klee | 62/50.7 |
| 3,633,372 | 1/1972 | Kimmel et al. | 62/49 |
| 3,946,572 | 3/1976 | Bragg | 62/50.1 |
| 4,175,395 | 11/1979 | Prost et al. | 62/52 |
| 4,321,796 | 3/1982 | Kohno | 62/52 |
| 4,932,214 | 6/1990 | Nieratscher et al. | 62/50.6 |
| 5,127,230 | 7/1992 | Neeser et al. | 62/7 |
| 5,373,700 | 12/1994 | McIntosh et al. | 62/48 |
| 5,409,046 | 4/1995 | Swenson et al. | 141/11 |
| 5,421,160 | 6/1995 | Gustafson et al. | 62/7 |
| 5,465,583 | 11/1995 | Goode | 62/50 |

OTHER PUBLICATIONS

Toby L. Peelemuter, "First 'Self-Serve' LNG Vehicle Fueling Station Installed", (CryoGas International) Jul., 1995, pp. 9–12.

Jeff Beale, "Design and Operation of the World's First 'Self-Serve' LNG Vehicle Refueling Station" presented at the 13th National NGV Conference and Exhibition (Oct. 15, 1995).

*Primary Examiner*—Ronald C. Capossela
*Attorney, Agent, or Firm*—Rudnick & Wolfe

[57] ABSTRACT

A portable self-contained delivery station for liquid natural gas (LNG) is provided on a movable skid frame and equipped with an instant -on delivery system which may initiate LNG delivery immediately to a use vehicle. The skid is equipped with a spill containment feature such that the LNG may be contained in the event of spillage. A variable speed pump both controls LNG dispensing and saturation levels of the stored LNG. The pump is submerged in a sump tank which is separate from the bulk storage tank. The sump tank is flooded with an amount of LNG such that the pump is submerged. Delivery of LNG may thus occur instantly, without pre-cooling of the pump or associated meter.

15 Claims, 2 Drawing Sheets

SELF-CONTAINED LIQUID NATURAL GAS FILLING STATION

Environmental and economic concerns have resulted in a widespread effort to develop fuel substitutes for gasoline and diesel fuel. The U.S. government has recently initiated policies which require adoption of alternative fuels in government and private vehicle fleets. Alternative fuel development efforts have focused on systems that are based on natural gas, whose main component is methane, which presents a viable alternative to gasoline because natural gas is relatively inexpensive, burns cleanly and produces emissions which are much less harmful to the environment. Entire fleets of government and industry vehicles, as well as some privately-owned vehicles, have been successfully converted to natural gas power systems.

BACKGROUND

The invention relates generally to storage devices for cryogenic fluids, especially liquid natural gas (LNG). More specifically, the invention relates to a portable self-contained delivery station for LNG for the purposes of fueling vehicles.

It is advantageous to store and dispense natural gas as a liquid, rather than a compressed gas, in order to reduce the space necessary to contain the fuel in the dispensing apparatus and in the vehicle fuel tank. In contrast to conventional liquid fuels like gasoline, LNG is a cryogenic fluid with a boiling point below −150° C. and therefore presents distinct storage and dispensing problems. Specifically, LNG storage facilities must minimize heat transfer from the ambient surroundings to the stored LNG in order to prevent unnecessary boiling and evaporation of the LNG. LNG storage facilities must also be capable of maintaining and dispensing the LNG in a homogenous liquid phase, i.e., without any vapor present in the liquid. Homogenous phase LNG is advantageous because it permits accurate metering and measurement of the amount of fluid dispensed to the vehicle and permits the maximum fuel amount to be stored in the vehicle tank. It is therefore advantageous for LNG dispensing facilities to control the saturation of the LNG. Saturated LNG is at the maximum temperature at which it can remain in a homogenous liquid state at a given pressure. Heat added to the saturated liquid yields an increase in pressure as some of the saturated liquid is converted to gas. Saturation permits effective control of the pressurization of the fuel system.

Pilot programs for testing and demonstration of the viability of LNG as a fuel alternative require pilot distribution facilities which are capable of efficiently storing large amounts of LNG and dispensing it to a fleet of use vehicles. Because of the different storage requirements for LNG and conventional fuels, it is impractical and economically unfeasible to modify existing gasoline distribution facilities for LNG. It is therefore advantageous to minimize the capital investment in site improvements required to install LNG pilot distribution facilities since it is difficult to recapture such outlays during the relatively short life of the facility. An ideal storage facility will be portable and self-contained to permit quick transport and installation at different distribution sites.

The prior art has provided numerous storage and dispensing systems for LNG, but has heretofore ignored, or failed to solve the problems inherent in providing a portable, self-contained fueling station that is capable of quick installation and in which fluid delivery and accurate metering may be initiated almost instantly. Thus, a major obstacle to the success of LNG fuel programs has been the development of a self-contained distribution facility which may be quickly installed with little or no investment in site improvements and which may dispense fuel immediately upon delivery to the distribution site. Many transports used to deliver LNG are not equipped with pumps. The pump in this system is supplied with connections to permit the bulk storage tank to be filled from the transport.

SUMMARY OF THE INVENTION

The present invention solves the aforementioned problems by providing a portable self-contained LNG storage facility which is capable of quick delivery of fuel. A cryogenic storage tank stores a bulk supply of LNG and is connected to a small cryogenic sump tank which houses a variable speed pump and meter. A vacuum insulated conduit connects the bulk storage tank with the sump tank such that LNG flows by gravity to the sump tank. The pump and meter are submerged in LNG in the sump tank to maintain them at the temperature of the LNG. Delivery of LNG may commence instantly, without pre-cooling of the pump or meter.

A saturation or heat exchange coil is provided which may be used to saturate LNG in the main storage tank to maintain adequate system pressure. This is necessary to provide proper fuel pressure to the engines of the motorized gas powered vehicles. Sloshing in a vehicle mounted tank renders a pressurizing system normally used on cryogenic tanks ineffective. The pump is provided with a meter bypass line which communicates with the saturation coil. LNG may be pumped to the saturation coil for warming and conveyed through a diffuser to the bulk storage tank, thus transferring heat to the LNG and increasing the saturation pressure in the bulk storage tank to that required by the use device, usually a vehicle.

DETAILED DESCRIPTION

Figure 1:
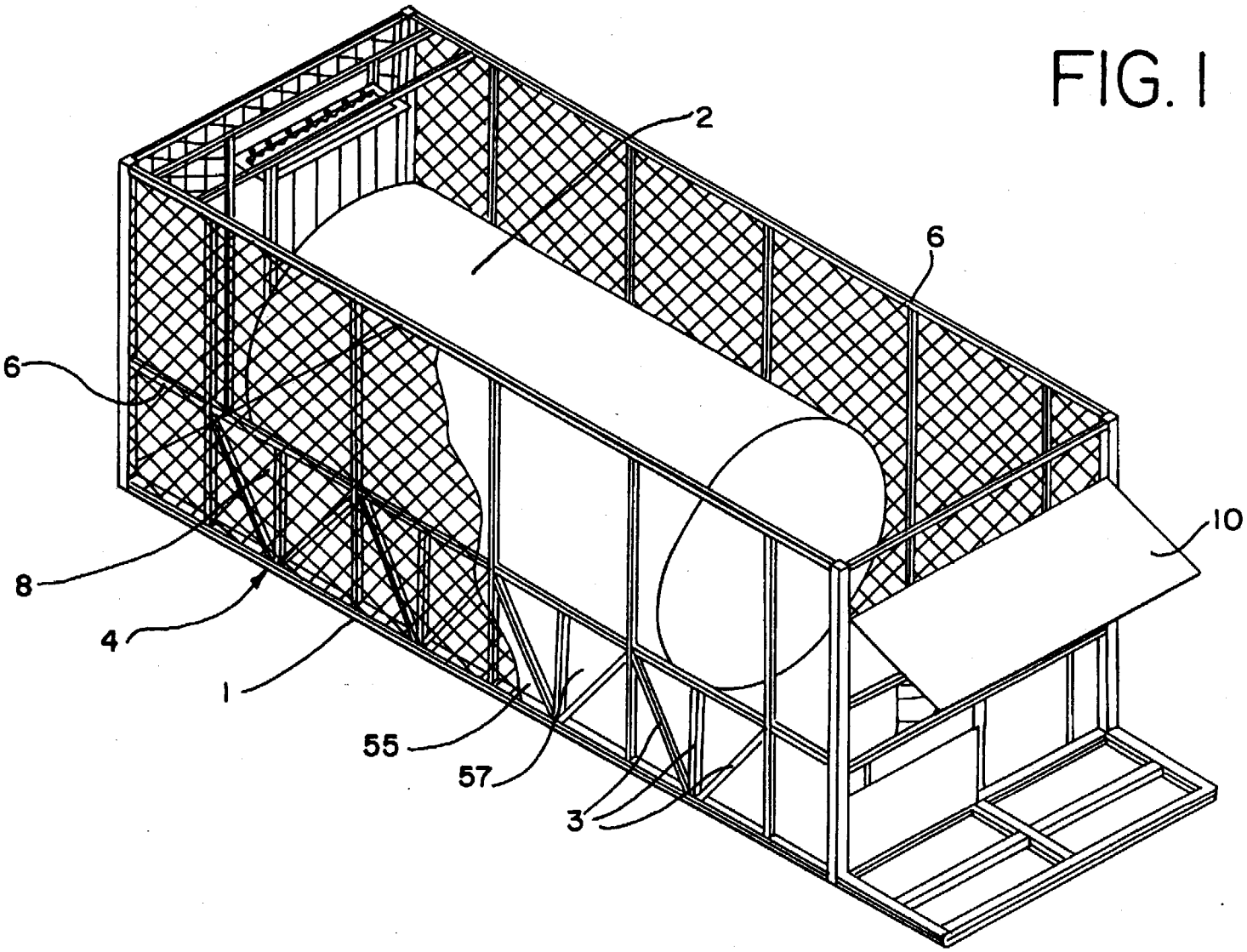
FIG. 1 is an isometric of a filling station according to a preferred embodiment of the present invention.

Referring to FIG. 1, a preferred embodiment of the present invention comprises a self-contained storage tank 2 which is supported on a rugged support skid 4 constructed of a welded I-beam framework configured in a rectangular box shape. Side walls 6 are formed of vertically disposed I-beams, cross-members, and metal fencing 8. Side walls 6 enclose and protect the various components of the delivery system, including the main storage tank 2, from unauthorized tampering or damage during and after transport. A lighting panel 10 is provided on skid 4 for illuminating the facility at night. Skid 4 provides a portable foundation for storage facility 2 and facilitates the quick loading and unloading of the facility 2 from a transport vehicle such as a flatbed trailer.

Containment means, in the form of a spill containment dam 55 surrounds the base of tank 2 and is comprised of a series of metal panels 57 and cross-members 3 fastened to the framework of skid 4. Panels 57 are dimensioned to define a spill containment volume which is preferably equal to the maximum volume of LNG that may be contained in the delivery station. In the event of a system emergency where the stored LNG escapes from the storage tank 2, dam 55 prevents the overflow of LNG into the area near the storage facility, thereby maintaining the safety of the surrounding area and personnel.

Figure 2:
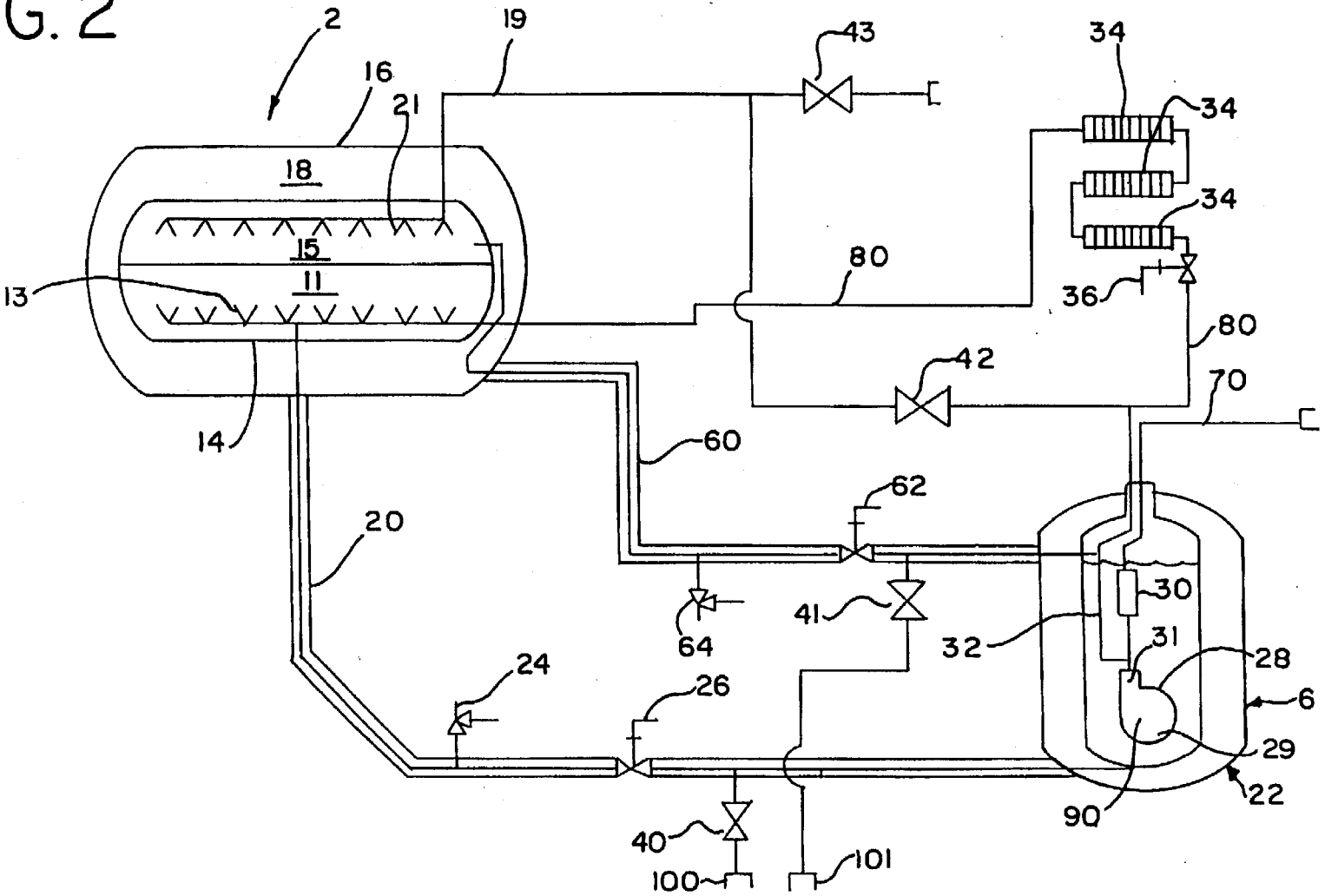
FIG. 2 is a schematic of the filling station of FIG. 1.

Referring to FIG. 2, the components of the storage and dispensing system include bulk storage tank 2, which includes a double-walled structure having an inner storage vessel 14 surrounded by an outer shell 16 to define an insulating space 18 therebetween. Inner vessel 14 normally contains a volume of LNG 11 and a gas head 15 above it. An LNG inlet line 19 communicates with the interior of inner vessel 14 to deliver LNG from a transport vehicle. Spray heads 21 permit the collapse of pressure in the gas head 15 inside the vessel as will be described below.

An insulated line 20 permits LNG to flow from the interior of inner vessel 14 to sump tank 22. Line 20 is vacuum insulated in a known manner, to prevent heat transfer to the LNG. Inlet valve 26 controls the flow of LNG in line 20. Sump tank 22, which has a double-walled structure like that of tank 2, is disposed below tank 2 such that LNG flows by gravity from storage tank 2 to the sump tank 22. Thus, sump tank 22 is constantly filled with LNG, as long as LNG is present in bulk storage tank 12.

An insulated vent line 60 is provided to vent gas from sump tank 22 back to main storage tank 2. Vent line 60 is insulated to prevent the transfer of ambient heat to the vented gas and ultimately to the stored LNG. A valve 62 is provided for initiating or stopping gas flow from sump tank 22. Valves 26 and 62 will be open when main tank 2 is being filled from a transport vehicle in order to permit LNG to flow into sump tank 22 and to permit gas in sump tank 22 and/or the transport. More specifically, the filling procedure involves isolating the pump from the storage tank by closing the vent return valve 62 and liquid feed valve 26, connecting the delivery unit discharge line to connection 100 and the vapor recovery line to connection 101; opening manual valves 40 and 41 allows liquid to gravity feed the pump sump, open valve 42 and starting the pump 90 to utilize the pump to assist in filling of the storage tank.

Pump 28 and meter 30 are submerged in the LNG contained in sump tank 22. The inlet 29 of pump 28 communicates with the LNG and the outlet 31 of pump 28 is connected to the inlet of meter 30 which is connected to an LNG delivery line 70 and control valve 71 through which LNG is delivered to the vehicle tank. A meter bypass line 32 provides unmetered LNG to saturation coils 34 as will be described below. Since pump 28 and meter 30 are submerged in LNG, both are maintained at the temperature of the fluid. Pre-cooling of the pump 28 and meter 30 is not necessary to prevent boiling of the LNG and undesirable two-phase fluid being metered into the use vehicle. The storage facility may thus respond quickly to demands for LNG.

Pump 28 also functions to control the saturation pressure of the LNG. When bulk storage tank 2 is initially filled with LNG from a transport vehicle, there is a significant drop in pressure of gas head 15 because the incoming LNG cools the vapor in the storage tank 12, collapsing the head and reducing the pressure therein. Also, the LNG being delivered from the transport vehicle is very cold relative to the temperature at which it is desirable to deliver the LNG to the use vehicle tank. Thus, the stored LNG may not have sufficient pressure for delivery to the use vehicle. Moreover, there is the possibility of dispensing sub-cooled LNG into the use vehicle tank, in which case there may not be sufficient pressure from the vehicle fuel tank to deliver fuel to the vehicle power system.

The present invention solves these problems by providing heat exchange means or saturation coils 34 in a secondary conduit 80 leading back to the bulk storage tank 2 via a meter bypass connection 32. When it is necessary to increase the system pressure, saturation coil valve 36, which comprises a means for diverting cryogenic fluid into the secondary conduit 80 and which is maintained in a closed position during LNG dispensing, is opened to permit flow of LNG to the saturation coil 34. Pump 22 is activated to initiate flow of LNG to the coils 34. As the LNG passes through the coils, the LNG absorbs ambient heat and is warmed and/or vaporized. It is then conveyed to the bulk storage tank where it is bubbled upwardly through diffuser 13. The temperature of the LNG stored in bulk storage tank 12 is increased until sufficient pressure exists to insure proper operation of the use device when the LNG is loaded into its fuel tank.

Pump 22 is a variable speed pump which is capable of pumping LNG at a high rate during the dispensing operation and a low rate during the saturation operation. In the saturation operation, the speed of the pump may be controlled to achieve a particular flow rate through heat exchanger or saturation coils 34. In this manner, the amount of ambient heat transferred to the cryogenic fluid passing through coils 34 may be controlled.

It will be understood by those of ordinary skill that the foregoing is intended to illustrate the preferred embodiments of the invention. Various modifications are possible within the scope of the invention as set forth in the appended claims.

What is claimed is:

1. A self-contained delivery station for storing and dispensing cryogenic fluid to a use device, comprising:

a) a bulk storage tank independent of the use device for receiving and storing cryogenic fluid;

b) a sump tank independent of the use device for receiving cryogenic fluid from the bulk storage tank, the sump tank housing a pump submerged in the cryogenic fluid contained therein;

c) an insulated conduit for conveying cryogenic fluid from the bulk storage tank to the sump tank; and d) a pump outlet conduit for conveying cryogenic fluid from the pump to the use device;

whereby the pump is maintained at the temperature of the fluid in the sump tank such that dispensing of cryogenic fluid from the sump tank to the use device may begin without pre-cooling of the pump.

2. The delivery station of claim 1, further comprising frame means for supporting the bulk and sump tanks above ground and for permitting the transport of the delivery station as a single unit on a flat surface.

3. The delivery station of claim 2, wherein the frame means further comprises containment means for accommodating the cryogenic fluid from the bulk and sump tanks in the event of leakage.

4. The delivery station of claim 2, wherein the frame means includes means for shielding the bulk tanks and sump tanks from view and from the elements.

5. The station of claim 1, further including a meter disposed in the sump tank and submerged in the cryogenic fluid, to meter the delivery of cryogenic fluid to the use device.

6. The delivery station of claim 1 further including an insulated conduit for conveying any vapor in the sump tank back to the bulk storage tank to insure that only liquid is delivered to the use device.

7. A self-contained delivery station for storing and dispensing cryogenic fluid to a use device, comprising:

a) a bulk storage tank independent of the use device for receiving and storing cryogenic fluid;

b) a sump tank independent of the use device for receiving cryogenic fluid from the bulk storage tank, the sump tank housing a pump submerged in the cryogenic fluid contained therein;

c) an insulated conduit for conveying cryogenic fluid from the bulk storage tank to the sump tank;

d) a pump outlet conduit for conveying cryogenic fluid from the pump to the use device; and e) means for selectively diverting cryogenic fluid from the pump back to the bulk storage tank to saturate the cryogenic fluid in the bulk storage tank, said means including heat exchange means for warming the cryogenic fluid diverted to said bulk storage tank.

8. The delivery station of claim 7, wherein said pump is a variable speed pump capable of operating at a high speed to dispense the cryogenic fluid to the use vehicle and a low speed to pump cryogenic fluid through said secondary conduit.

9. The delivery station of claim 7, further comprising frame means for supporting the bulk and sump tanks above ground and for permitting the transport of the delivery station as a single unit.

10. The delivery station of claim 9, wherein the frame means further comprises containment means for accommodating the cryogenic fluid from the bulk and sump tanks in the event of leakage.

11. The delivery station of claim 9, wherein the frame means includes means for shielding the bulk tanks and sump tanks from view and from the elements.

12. The station of claim 7, further including a meter disposed in the sump tank and submerged in the cryogenic fluid, to meter the delivery of cryogenic fluid to the use device.

13. The delivery station of claim 7 further including an insulated conduit for conveying any vapor in the sump tank back to the bulk storage tank to insure that only liquid is delivered to the use device.

14. A self-contained delivery station for storing and dispensing cryogenic fluid to a use device, comprising:

a) a bulk storage tank independent of the use device for receiving and storing cryogenic fluid;

b) a sump tank independent of the use device for receiving cryogenic fluid from the bulk storage tank, the sump tank housing a pump submerged in the cryogenic fluid contained therein;

c) a first conduit for conveying cryogenic fluid from the bulk storage tank to the sump tank;

d) a second conduit for conveying cryogenic fluid from the pump to a use device; and e) means for selectively transferring ambient heat to the bulk tank to saturate the fluid stored therein, said means comprising:

(i) a third conduit for conveying cryogenic fluid from the pump to the bulk storage tank; and (ii) heat exchange means in circuit with said third conduit for warming of cryogenic fluid.

15. The delivery station of claim 14, wherein the pump means comprises a variable speed pump for pumping the cryogenic fluid at different rates during a dispensing operations and heat transferring operations.

* * * * *